United States Patent [19]

Goodman

[11] Patent Number: 4,842,036

[45] Date of Patent: Jun. 27, 1989

[54] VERTICAL BLIND SLATS, AND ASSEMBLIES AND COMPONENTS THEREOF

[76] Inventor: Barry I. Goodman, 10220 SW. 129th St., Miami, Fla. 33176

[21] Appl. No.: 521,353

[22] Filed: Aug. 8, 1983

[51] Int. Cl.[4] ..... E06B 9/26

[52] U.S. Cl. ..... 160/166.1; 160/236; 428/40; 428/105; 428/131; 428/192; 428/284; 428/292; 428/293; 428/294; 428/343; 428/354; 428/247

[58] Field of Search ..... 428/292, 294, 284, 287, 428/343, 192, 193, 255, 110, 247, 40, 131, 105, 109, 293, 354; 160/236, 166 A

[56] References Cited

U.S. PATENT DOCUMENTS

| | | | |
|---|---|---|---|
| 2,074,482 | 3/1937 | Martens | 157/17 |
| 2,090,145 | 8/1937 | Pierce | 156/17 |
| 3,472,305 | 10/1969 | Lefes | 160/236 |
| 3,591,434 | 7/1971 | Hartstein | 156/178 |
| 3,598,689 | 8/1971 | Feffer et al. | 428/294 |
| 3,645,317 | 2/1972 | Malone | 160/168 |
| 4,049,038 | 9/1977 | Hyman et al. | 160/166 A |
| 4,110,505 | 8/1978 | Prewo | 428/294 |
| 4,195,680 | 4/1980 | Hyman et al. | 160/166 A |
| 4,292,367 | 9/1981 | Tesch | 428/294 |
| 4,307,145 | 12/1981 | Goldman | 428/294 |
| 4,309,472 | 1/1982 | Gotting et al. | 428/224 |
| 4,348,445 | 9/1982 | Craig | 428/255 |
| 4,434,200 | 2/1984 | Fash et al. | 428/257 |

FOREIGN PATENT DOCUMENTS

| | | |
|---|---|---|
| 8021397 | 10/1980 | France . |
| 1341556 | 5/1980 | United Kingdom . |

*Primary Examiner*—James J. Bell

*Attorney, Agent, or Firm*—Kenyon & Kenyon

[57] ABSTRACT

Laminates particularly useful in vertical blind slat assemblies, and vertical blind slat assemblies utilizing the laminates are disclosed. The laminates comprise strand material which is not free hanging and in which there are substantial spaces between the strands to allow light to pass through the material, and a sheet-like layer to which the strand material is secured so that the strands of the laminate are fixed. The laminates allow the color or other characteristics of a slat member or insert to be seen. The laminates can have differing surface characteristics, (e.g. texture) and strand colors, sizes and patterns. The sheet-like layer can be transparent or translucent. A laminate can be secured directly, for example by adhesive, to a slat member having light-transmitting properties (e.g. opaque or translucent), surface characteristics (e.g. texture) and/or color which affect the overall appearance of the slat. A laminate can be removably secured to a groover slat member which can have light-transmitting properties, surface characteristics and/or color which affect the overall appearance of the slat. An insert can be disposed between the laminate and the groover slat which itself has light-transmitting properties (e.g. opaque, translucent), surface characteristics and/or color or print which affect the overall appearance of the slat. The laminate allows the insert and/or slat member to be seen, to provide color, etc. to the slat assembly. The laminates allow a vertical blind slat to be assembled easily from a particular laminate and slat member, and insert if used. By stocking a limited number of laminates, slat members and inserts, a wide variety of slat assemblies can be provided. The laminates can have a plastic or fabric second layer to which the strand material is secured.

33 Claims, 3 Drawing Sheets

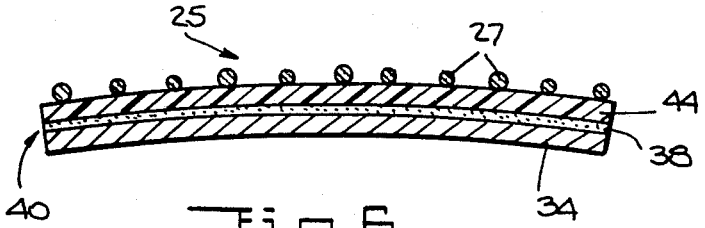
Fig. 6.
Fig. 7.
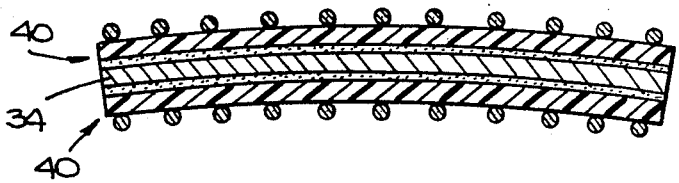
Fig. 8.
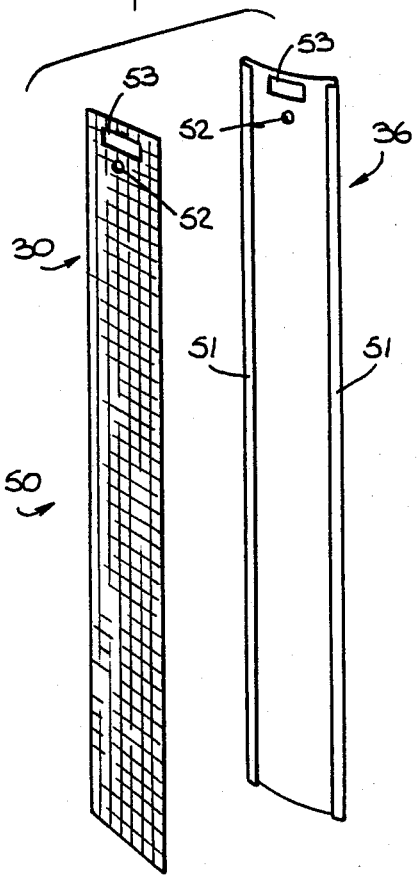
Fig. 9.
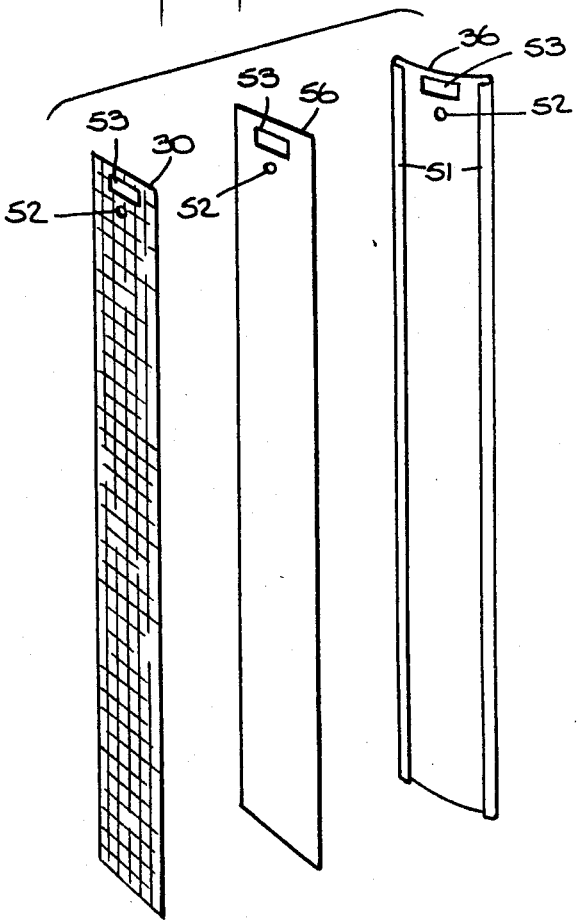

VERTICAL BLIND SLATS, AND ASSEMBLIES AND COMPONENTS THEREOF

BACKGROUND OF THE INVENTION

The present invention relates to a laminate for a window or other opening covering, or divider, such as a vertical blind, window shade or a screen, to assemblies including the laminate, and to vertical blind slates, and assemblies and components thereof.

Heretofore, material which was not free-hanging as a vertical blind slat such as a fabric or strand material and which was to be used as a vertical blind slat or as part of a vertical blind slat, was treated chemically to make it free hang, was secured with or without chemical treatment directly to a vertical blind slat member such as an aluminum slat member, or glued to an opaque backing such as paper which was in turn secured to the slat member. By free hanging it is meant that a material or member hangs as a vertical blind slat without the aid of a support such as a supportive backing. Examples of free-hanging members are aluminum and PVC vertical blind slat members and examples of free-hanging materials are some woven and non-woven fabrics with and without chemical treatment.

It is difficult to secure a loosely-woven or non-woven fabric or strand material to a slat member because of the difficulty in maintaining the material in a desired configuration as it is being secured to the slat member, and chemical treatment of such a material often results in an encapsulation of the material so as to reduce or eliminate the surface dimension or texture of the material. Moreover, only limited number of slat assemblies of different appearance were available because both slat members and coverings for the slat members such as material on backing were available in only a limited number of colors and patterns.

OBJECTS AND SUMMARY OF THE INVENTION

It is an object of the present invention to provide vertical blind slat components and vertical blind slat assemblies made from the components in which a selection of two or more of the components determines one or more of the following characteristics of the slat assembly: color, optical properties and surface characteristics.

It is another object of the present invention to provide a variety of such slat components which can be assembled into a large number of different-appearing slat assemblies from a limited or modest stock of the components.

It is another object of the present invention to utilize a material comprising spaced strands between which light can pass as a component of a window or other opening covering or divider.

It is another object of the present invention to utilize such a material as a component of a vertical blind slat assembly.

It is another object of the present invention to provide such material as an insert for a vertical blind slat assembly.

It is another object of the present invention to provide such material which can easily be adhered to a vertical blind slat member.

It is another object of the present invention to provide vertical blind slat assemblies which include such a material.

It is another object of the present invention to provide a vertical blind slat assembly in which such material can be simply and inexpensively installed.

It is another object of the present invention to provide a vertical blind slat assembly in which such material can be simply and inexpensively installed and removed.

It is another object of the present invention to provide such material as a free-hanging vertical blind slat.

The above and other objects are achieved by the invention disclosed herein.

According to the invention, a laminate is provided comprising a first layer of material which is comprised of strands of material arranged with spaces between the strands through which light can pass and a second sheet-like layer of light-transmitting material to which the first layer is joined with its material strands fixed. Laminate is used herein in a broad sense to mean united superposed layers of one or more materials. The second layer provides at least some rigidity to the first layer and makes it easier to join the first layer to a slat member, for example by insertion into a groover or laminating to an aluminum or plastic slat member. The first material layer is joined to the second layer without stitching. The laminate is light transmitting and can be for example transparent or translucent so that when applied to a vertical blind slat member, for example, the overall appearance of the assembly of the slat member and laminate will be determined in part by whatever is behind the laminate, for example, the slat member. Thus, the color, for example, of the slat member or something secured to the slat member will be visible through the laminate. Moreover, the laminate provides a free-hanging string effect.

The first layer of the laminate is preferably a fabric material. Non-woven or loosely-woven fabric or yarn materials having substantial spaces between strands of the fabric are particularly desirable, particularly where the strands are of a substantial thickness and are substantially spaced so as to provide surface dimension or texture to the laminate. A material forming the first layer can be of a particular color or color pattern and the strands can be of a particular size or arranged in a particular pattern. The second layer of the laminate is preferably a plastic material, most preferably a clear, transparent plastic material, for example a polyester film. The second layer can also be a light transmitting fabric, particularly a non-woven fabric. The second layer can be of a particular color or color pattern, have particular surface characteristics and/or particular light-transmitting characteristics.

A laminate can therefore be of a particular color or color pattern, have a particular strand pattern, have particular surface characteristics and have particular light-transmitting characteristics.

A slat member can be of a particular color or color pattern, have particular surface characteristics and have particular light-transmitting characteristics. For example, a slat member can be reflective, opaque or translucent, or have perforations, etc. A slat member can, for example, be made of a light-weight metal such as aluminum or a plastic such as PVC.

The substantial spaces between strands of the material of the first layer of the laminate enable visual observation of the surface behind the laminate, particularly when the second layer of the laminate is transparent. Thus, the color, for example, of the surface behind the laminate will play a part in determining the overall appearance of the slat assembly so that many variations of slat assemblies are possible.

According to an aspect of the invention, the laminate is joined to a vertical blind slat member in any convenient way. The laminate can be provided so that is may be adhered to a slat member to form an adhered laminated slat assembly or as an insert which can be mechanically held by a slat member. However, adhesive joining of the laminate to an aluminum or PVC slat member, or insertion of the laminate in a slat member known in the art as a "groover" are preferred. The overall appearance of the vertical blind slat assembly can be determined simply by joining a selected laminate to a selected slat member which can be done at almost any level in the manufacturing and distribution chain.

The laminate can be provided with an adhesive layer on the side of the second layer which is not joined to the first layer so that the laminate can easily be applied to a slat member. The adhesive is preferably a pressure sensitive, clear, transparent adhesive covered by a removable protective layer, for example, a paper layer. Thus, color, for example, will show through the adhesive.

In accordance with another aspect of the invention, a sheet-like insert is disposed in a vertical blind assembly between a slat member and a laminate. A sheet-like insert can be of a particular color or color pattern, print, have particular surface characteristics and/or particular light-transmitting characteristics. For example, a sheet-like insert can be reflective, opaque, translucent, a colored or printed transparency, or have perforations. The sheet-like insert can have surface texture defining differing patterns. A sheet-like insert can be made from many different materials, for example, paper, plastic, vinyl, etc. Thus, a sheet-like insert disposed between a particular laminate and a particular slat member will further affect the overall appearance of the slat assembly.

In accordance with another aspect of the invention, an assembly of a translucent slat member and a laminate according to the invention is provided. Such a slat assembly will have a different appearance depending on the intensity of the light in front of and behind the slat assembly. For example, during the day when the exterior light intensity behind the slat assembly is high, light passes through the slat assembly and the laminate to silhouette the strands of the strand material. A free-hanging string-effect vertical blind can be provided by translucent slat members and laminates according to the invention. Translucency also provides a filtering effect. Background color for the silhouetted strands will be determined by the slat member and by the second layer of the laminate. Background color could also be determined by a translucent sheet-like insert between the laminate and a translucent slat member. During the night when the exterior light intensity is low, the appearance of the slat assembly is different from that during the day and is determined by the laminate, the sheet-like insert if one is used, and the slat member as described above.

As indicated, the laminate can be affixed to a slat member, which for example can be an aluminum slat or a plastic slat, or provided as an insert for a plastic slat of the groover type. Selection of a particular slat member and a particular laminate will determine the appearance of the slat assembly. For example, with ten variations of slat members, for example different colors, and ten variations of laminates, one hundred different slat assembly combinations can be obtained. Even further variations are possible for slat assemblies which include a laminate, a groover and an insert held between the laminate and the groover. The number of different slat assemblies which can be formed can be equal to the square or even the cube of the number of different components available. Variations and effects can further be expanded when translucent slat members are used, as described above. Thus, by stocking a limited number of slat members, laminates and inserts, which differ as described above, a very large number of slat assembly combinations and effects is possible. Moreover, since the laminates and sheet-like inserts can easily be assembled with the slat members, an assembler or distributor, or even a retailer who stocks the limited number of components can provide a customer with a wide choice of slat assemblies.

The above and other objects, aspects, features and advantages of the invention will be more readily perceived from the following description of the preferred embodiments thereof when considered with the accompanying drawings and appended claims. BRIEF DESCRIPTION OF THE DRAWINGS The present invention is illustrated by way of example and not limitation in the figures of the accompanying drawings in which like references indicate similar parts and in which:

FIG. 6 is a cross-section view of a vertical blind slat assembly according to the invention in which the laminate of FIG. 5 is adhered to a vertical blind slat member 3;

FIG. 7 is a cross-section view similar to that of FIG. 6 of a vertical blind slat assembly according to the invention in which the laminate of FIG. 5 is adhered to each side of a vertical blind slat member;

FIG. 8 is an exploded perspective view of a vertical blind slat assembly according to the invention including a groover slat member and the laminate of FIG. 4;

FIG. 9 is an exploded perspective view of a vertical blind slat assembly according to the invention including a groover slat member, a sheet-like insert and the laminate of FIG. 4;

DESCRIPTION OF THE PREFERRED EMBODIMENTS

With reference now to the drawings, laminates and vertical blind slat assemblies according to the invention are illustrated. Although the preferred embodiments are described in connection with vertical blinds, the laminates according to the invention and assemblies using the laminates can be employed in other types of coverings for windows, doors, etc., dividers, such as window shades, shoji screens and decorative screens.

Figure 1:
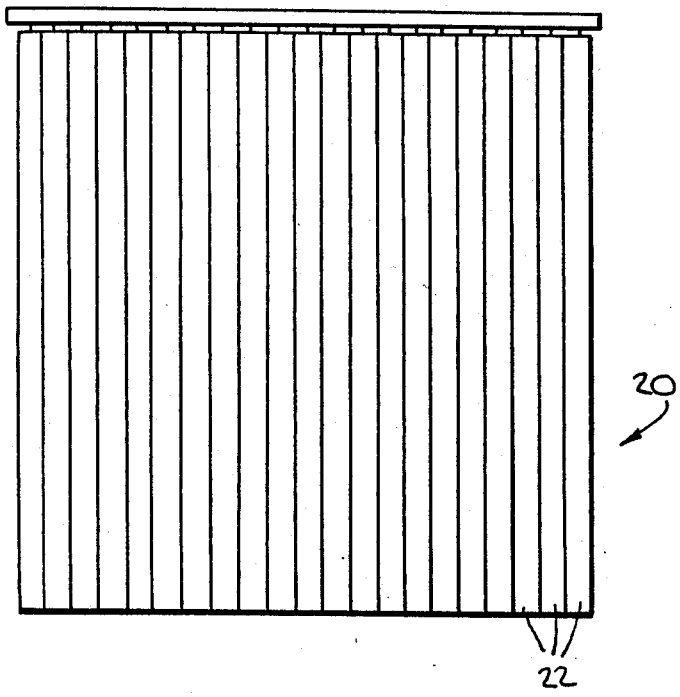
FIG. 1 is a front view of a vertical blind.

A vertical blind 20 comprising slat assemblies 22 which include laminates according to the invention is depicted in FIG. 1.

Figure 2:
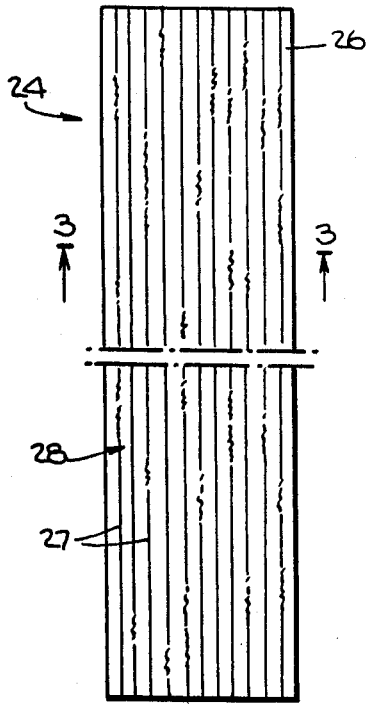
FIG. 2 is a front view of a laminate according to the invention.
Figure 4:
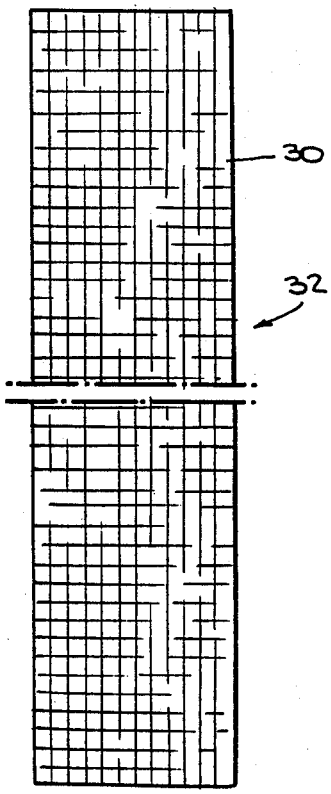
FIG. 4 is a front view of another laminate according to the invention.
Figure 3:
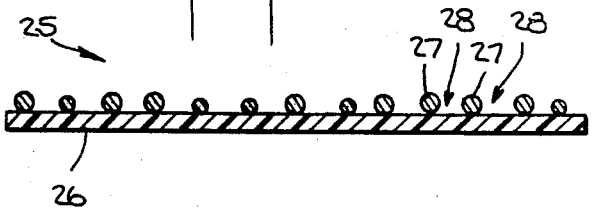
FIG. 3 is a cross-section view, exaggerated for clarity, of the laminate of FIG. 2 taken through line 3—3 of FIG. 2.

Referring to FIGS. 2 and 3, a laminate 24 which may form part of a slat assembly 22 is comprised of a first layer 25 and a second layer 26. The first layer 25 is made of a material comprised of strands 27 which are separated by spaces 28 so that light can pass between the strands and material behind the strands can be seen. The first layer 25 is frequently not free hanging so that it is not suitable for use alone as a vertical blind slat. The first layer 25 is preferably a fabric material in which the strands can be woven (FIG. 4) or non-woven. However, other materials may be used depending on the characteristics of the material and the effect desired. The strand pattern, shape, strand spacing, size, color, color pattern, etc., can be selected as desired to achieve a particular visual or aesthetic effect. Thus, strand parameters can be varied and many types of laminates can be provided with variation of the first layer alone. Another first layer fabric material 30 for a laminate 32 is depicted in FIG. 4. The strands of the fabric material 30 are loosely woven together in a grid pattern.

The first material layer 25 (FIG. 3) is secured to the second layer 26 by known stitchless processes such that a varying thickness or surface dimension, or texture, defined by the thickness of the strands of the first material layer results, as depicted in FIG. 3.

The optical and surface properties of the second layer of the laminate can vary so that further variations of laminates can be provided. For example, the second layer can have particular surface characteristics, be of a particular color, be transparent or translucent, etc.

The second layer 26 is preferably a plastic sheet or film, for example, a polyester film, which can be transparent or translucent. When the second layer is a plastic sheet or film, the material of the first layer can be secured to the second layer by known processes. The first material layer 25 may for example be secured to the second layer by an adhesive which does not fill the spaces between strands so as not to destroy the surface definition of the strands or the see-through qualities of the strand material. The adhesive can, for example, be applied to the fabric and/or second layer in a thin coating. The adhesive is light transmitting and is preferably clear and transparent.

The laminate can be made in sheet form and cut to vertical blind slat size. As mentioned, processes for making the laminates are known to those of skill in the art.

The laminate can itself constitute a vertical blind slat, as shown in FIGS. 11–14, in which case the mechanical properties of the second layer will be selected accordingly.

Figure 5:
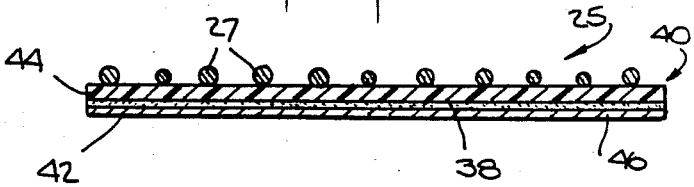
FIG. 5 is a cross-section view similar to that of FIG. 3 of a laminate similar to that of FIG. 2 having an adhesive coating on one side of the laminate covered by a protective layer.

However, it is preferred that the laminate form part of a vertical blind slat assembly in which the laminate is secured to a vertical blind slat member either adhered or as an insert. The laminate can be adhesively secured to a slat member 34 as depicted in FIG. 6 or removably secured in a groover slat member 36 as depicted in FIGS. 8–11. In the embodiment depicted in FIG. 6, a clear transparent adhesive 38 is applied to either or both the laminate 40 of FIG. 5 and the slat member 34 of FIG. 6, and the laminate applied to the slat member. Preferably, the slat member 34 is aluminum.

In order to facilitate applying the laminate 40 to the slat member 34, the side 42 of the second layer 44 of the laminate 40 (the side to which the first layer is not joined) can be supplied covered with the clear transparent adhesive 38. Preferably, the adhesive 38 is a pressure sensitive adhesive, and a removable protective sheet 46 covers the adhesive layer. By simply peeling off the protective sheet 46, the laminate 40 is ready to be adhered to a slat member.

FIG. 7 depicts two laminates 40 adhered to a slat member 34, one one each side of the slat member.

Slat members can be of different colors or color patterns, have differing surface characteristics and can have differing light-transmitting properties. Slat members can be made of metal such as aluminum or plastic such as PVC. They can be translucent, opaque or even perforated. Since the strands of the laminate are spaced and the second layer is light-transmitting, preferably transparent, the surface quality of the slat member will affect the overall visual effect of the slat assembly. As a result, by selecting a particular slat member and a particular laminate, many slat assemblies of different appearances can easily be assembled. For example, a clear transparent second layer of the laminate will enable the color of the slat member to be seen through the spaces between the strand material, thereby providing a selectable color background to the strand material. For example, a stock of only ten different laminates and ten different slat members could provide one hundred different vertical blind slat assemblies.

Referring now to FIG. 8, a slat assembly 50 comprising a groover 36 and a laminate 30 is depicted. The groover 36 includes flanges 51 extending along the edges of the groover which are adapted to receive and hold a laminate. Other means such as a button 52 which is known in the art or an adhesive can be provided to secure the laminate to the slat member. A slot 53 is provided by means of which the slat assembly is suspended. Combinations as described above can be provided by selection of a particular laminate and a particular slat member. Moreover, since the laminate is an insert, it can be easily removed and replaced, even after installation. Thus, one can redecorate by changing a laminate rather than the entire vertical blind slat assembly.

Figure 10:
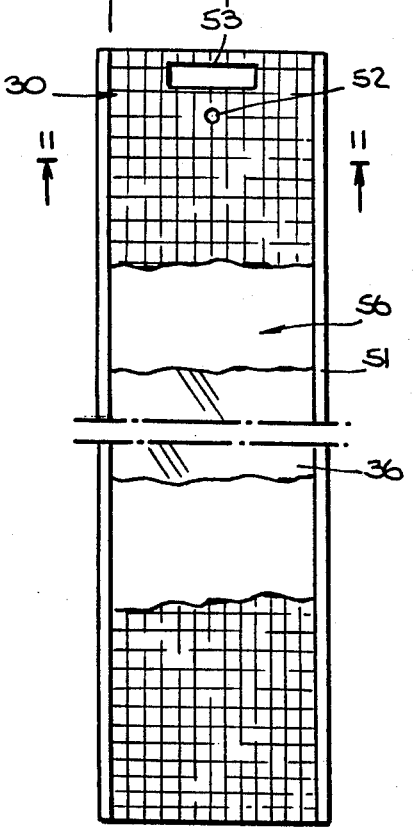
FIG. 10 is a front view of the slat assembly of FIG. 9 with portions thereof broken away.
Figure 11:
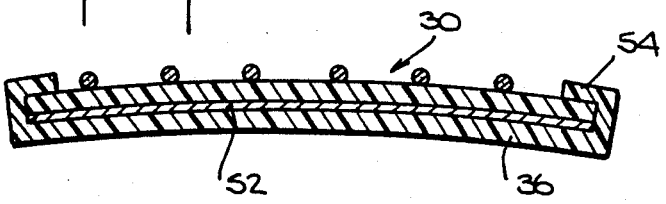
FIG. 11 is a cross-sectional view of the slat assembly of FIG. 9 taken through line 11—11 of FIG. 10.

Referring to FIGS. 9–11, a slat assembly 54 comprising a groover 36, a laminate 30 and an insert 56 is depicted. The flanges 51 and button 52 hold the laminate and sheet-like insert to the slat member. Sheet-like inserts can be of different color or color pattern, have different surface characteristics and have different light-transmitting properties. Sheet-like inserts can be made of paper, or plastic such as vinyl, and have surface characteristics to resemble leather or suede. The overall visual appearance of the slat assembly 54 is determined by the laminate, the sheet-like insert and possible the groover. Many variations are possible from a selection of the three components. If the groover and insert are translucent, further variations are possible, as described above for a translucent groover. The possibilities of different visual effects are virtually unlimited with a modest stocking of laminates, inserts and groovers.

Referring now to FIGS. 12–15, the second layer 26 of a laminate 58 can comprise a translucent fabric material 60 to which the strand material 25 is joined without stitching. The fabric material 60 is preferably a non-woven material held together by stitching 62, but lacking a surface dimensional character. The first material 25 is as described above and can be applied to the fabric layer by an adhesive in processes known to those of skill in the art. The first strand material provides surface definition to the fabric material 60 which may be free-hanging. Thus, a free-hanging slat of the fabric material and strand material may be provided which has a dimensional effect.

As in the laminates of FIGS. 2–4, the first material layer 25 when secured to the second material layer retains its surface definition and any adhesive used to secure the two does not destroy the surface definition of the strand material. The laminate can be made in sheets and cut to sizes suitable for blind slats and blind slat coverings.

The fabric material 60 can be of different colors and translucency and the first layer strand material 25 can be of different thicknesses, shapes, patterns, etc., as described above, so that again many different laminates can be provided. The laminate 58 shown in FIG. 12–13 includes one second layer fabric 60 and one first layer strand material 25.

Figure 14:
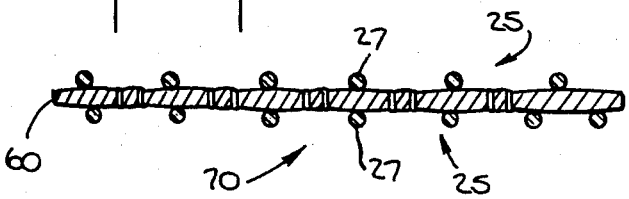
FIG. 14 is a cross-section view similar to that of FIG. 13 of another embodiment of a laminate according to the invention.
Figure 15:
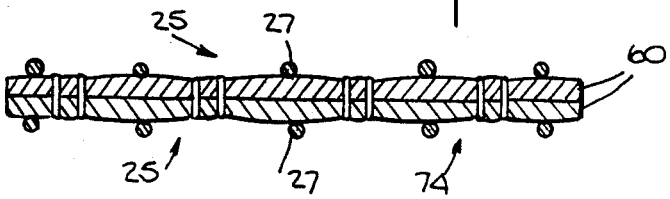
FIG. 15 is a cross-section view similar to that of FIG. 13 of another embodiment of a laminate according to the invention.

The laminate 70 depicted in FIG. 14 includes first layer strand material 25 on both sides of a fabric layer 60. The first layer material is applied to both sides as discussed for the laminate of FIG. 12. The first layer material may be different on each side of the fabric material 60.

Figure 12:
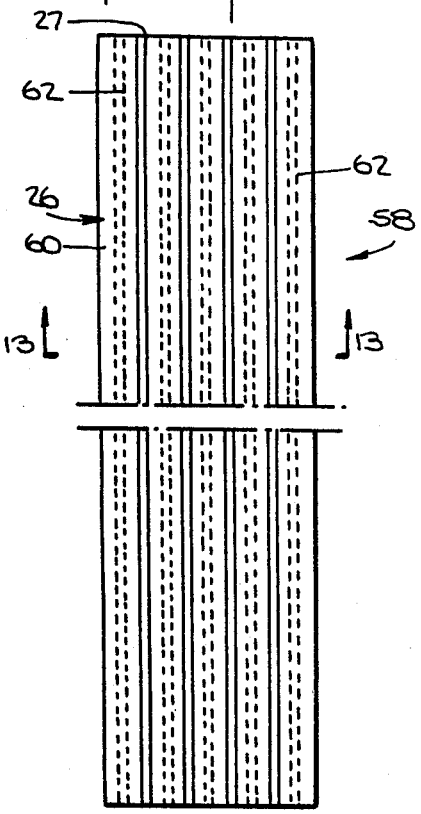
FIG. 12 is a front view of another embodiment of a laminate according to the invention.
Figure 13:
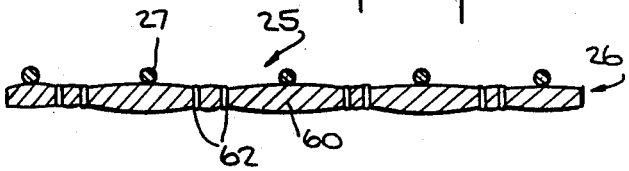
FIG. 13 is a cross-section view of the laminate of FIG. 12 taken through line 13—13 of FIG. 12.

In FIG. 14, the laminate 74 comprises two laminates of the type of FIGS. 12–13 secured together with the strand material layers 25 exposed. The two fabric layers 60 of FIG. 15 can be glued or stitched together.

Certain changes and modifications of the disclosed embodiments of the invention will be readily apparent to those of skill in the art. It is the applicant's intention to cover by the claims all those changes and modifications which can be made to the embodiments of the invention herein chosen for the purposes of disclosure without departing from the spirit and scope of the invention.

What is claimed is:

1. A blind comprising a plurality of associated slats each comprising a light transmissive laminate said laminate comprising a first layer of not free hanging material comprised of strands arranged in spaced relation to each other forming openings thru which light can pass; a second layer of light transmissive material stitchlessly joined to said first layer; and, said first layer providing a surface dimension or texture to the laminate.

2. The slat according to claim 1 wherein the second layer is transparent.

3. The slat according to claim 1 wherein the second layer is translucent.

4. The slat according to claim 1 wherein the second layer is a plastic material.

5. The slat according to claim 1 wherein the second layer is a translucent, free-hanging fabric material.

6. The slat according to claim 5 wherein the fabric material of the second layer is non-woven.

7. The slat according to claim 1 wherein the first layer is a fabric material.

8. The slat according to claim 1 comprising a layer of adhesive on the side of the second layer which is not joined with the first layer.

9. The slat according to claim 8 wherein the adhesive is pressure sensitive and the laminate includes a removable protective layer disposed over the adhesive.

10. A blind comprising a plurality of associated blind slat assemblies each comprising a slat member; a light transmissive laminate which comprises a first layer of not free hanging material comprised of strands of material arranged in spaced relation to each other forming openings thru which light can pass; a second layer of light transmissive material stitchlessly joined to said first layer; said first layer providing a surface dimension or texture to the laminate; and a means for removably securing the laminate to the slat member.

11. The vertical blind slat assembly according to claim 10 wherein the slat member is one of aluminum and plastic and the securing means is an adhesive.

12. The vertical blind slat assembly according to claim 11 wherein the slat member is perforated.

13. The vertical blind slat assembly according to claim 10 wherein the slat member is plastic.

14. The vertical blind slat assembly according to claim 13 wherein the securing means includes a pair of spaced flanges running along the edges of the slat member in which the edges of the laminate are disposed.

15. The vertical blind slat assembly according to claim 14 wherein the securing means removably hold the laminate.

16. The vertical blind slat assembly according to claim 13 wherein the securing means is an adhesive.

17. The vertical blind slat assembly according to claim 13 wherein the slat member is opaque.

18. The vertical blind slat assembly according to claim 13 wherein the slat member is translucent.

19. The vertical blind slat assembly according to claim 15 and including a sheet-like insert disposed between the laminate and the slat member.

20. The vertical blind slat assembly according to claim 22 wherein the sheet-like insert is removably held between the laminate and the slat member.

21. The vertical blind slat assembly according to claim 19 wherein the sheet-like insert is colored.

22. The vertical blind slat assembly according to claim 21 wherein the sheet-like insert is light-transmitting.

23. The vertical blind slat assembly according to claim 19 wherein the sheet-like insert is reflective.

24. The vertical blind slat assembly according to claim 10 wherein the slat member is plastic and the means for securing include spaced flanges running along the edges of the slat member in which are disposed the edges of the laminate.

25. The vertical blind slat assembly according to claim 10 and including a sheet-like insert removably held between the laminate and the slat member.

26. The vertical blind slat assembly according to claim 25 wherein the slat member is plastic and the means for securing include spaced flanges running along the edges of the slat member in which are disposed the edges of the insert and of the laminate.

27. The vertical blind slat assembly according to claim 26 wherein the insert is light transmitting and the slat member is translucent.

28. The vertical blind slat assembly according to claim 10 wherein the strands of the first material define a surface definition or texture and the laminate on the side of the first layer is correspondingly textured as provided by the first layer of the laminate.

29. The vertical blind slat assembly according to claim 26 wherein the sheet-like insert is colored.

30. The vertical blind slat assembly according to claim 10 wherein the slat member is translucent.

31. The vertical blind slat assembly according to claim 10 wherein the slat member is opaque.

32. The vertical blind slat assembly according to claim 26 wherein the sheet-like insert is reflective.

33. A blind slat assembly of different visual and/or physical characteristics comprising a light transmissive laminate having a first layer of not free hanging material comprised of strands arranged in spaced relation to each other forming openings thru which light can pass and a second layer of light transmissive material stitchlessly joined to said first layer and said first layer providing a surface dimension or texture to the laminate and joining the laminate to a slat.

* * * * *